US010113409B2

(12) United States Patent
Thompson

(10) Patent No.: US 10,113,409 B2
(45) Date of Patent: Oct. 30, 2018

(54) BORE MEASURING TOOL

(71) Applicant: Geonomic Technologies Inc., Saskatoon (CA)

(72) Inventor: Christopher Stephen Thompson, Calgary (CA)

( * ) Notice: Subject to any disclaimer, the term of this patent is extended or adjusted under 35 U.S.C. 154(b) by 212 days.

(21) Appl. No.: 15/208,512

(22) Filed: Jul. 12, 2016

(65) Prior Publication Data

US 2018/0016887 A1 Jan. 18, 2018

(51) Int. Cl.

| | |
|---|---|
| ***E21B 47/00*** | (2012.01) |
| ***E21B 47/12*** | (2012.01) |
| ***E21B 45/00*** | (2006.01) |
| ***E21B 47/022*** | (2012.01) |
| ***E21B 47/04*** | (2012.01) |

(52) U.S. Cl.

CPC ..... *E21B 47/00* (2013.01); *E21B 45/00* (2013.01); *E21B 47/022* (2013.01); *E21B 47/04* (2013.01); *E21B 47/12* (2013.01)

(58) Field of Classification Search

CPC ..... E21B 47/08; E21B 34/14; E21B 47/01
See application file for complete search history.

(56) References Cited

U.S. PATENT DOCUMENTS 2,267,110 A * 12/1941 Kinley ..... E21B 47/08 324/323
2,638,988 A * 5/1953 Williams ..... E21B 27/00 166/149
3,023,507 A * 3/1962 Camp ..... E21B 47/08 33/544.3
3,097,433 A * 7/1963 Cubberly ..... E21B 47/08 166/241.5
4,407,157 A * 10/1983 Lichtenberg ..... E21B 47/08 33/544.3
4,673,890 A * 6/1987 Copland ..... E21B 33/124 166/64
4,928,758 A * 5/1990 Siegfried, II ..... E21B 47/10 166/250.01

(Continued)

FOREIGN PATENT DOCUMENTS

| | | |
|---|---|---|
| CN | 202194653 U | 4/2012 |
| CN | 202421128 | 9/2012 |
| CN | 102337884 | 7/2014 |

*Primary Examiner* — Brad Harcourt
*Assistant Examiner* — Steven A MacDonald
(74) *Attorney, Agent, or Firm* — Richard D. Okimaw

(57) ABSTRACT

An apparatus for measuring a well bore wall comprises a casing connectable in line with a tool string having a central passage therethrough and extending between first and second ends and a plurality of longitudinally extending biasing elements extending longitudinally along the casing between first and second ends wherein each of the second end of the biasing elements is connected to the casing. The apparatus further comprises a sensor located along a midpoint of each of the biasing elements and an engagement body located within the central passage of the casing longitudinally displaceable therein between first and second positions, wherein the engagement body is connected to the first end of each of the biasing elements such that displacement of the engagement body within the central passage from the first to the second positions compresses and radially extends the biasing elements so as to engage the sensors against the well bore wall.

18 Claims, 5 Drawing Sheets

(56) References Cited

U.S. PATENT DOCUMENTS

| | | | | |
|---|---|---|---|---|
| 5,101,104 | A | 3/1992 | Schroeder | |
| 5,242,020 | A * | 9/1993 | Cobern | E21B 17/1021 166/254.2 |
| 5,243,562 | A * | 9/1993 | Laurent | E21B 47/01 166/250.16 |
| 5,353,873 | A * | 10/1994 | Cooke, Jr. | E21B 47/065 166/64 |
| 5,801,642 | A * | 9/1998 | Meynier | E21B 17/1028 181/108 |
| 6,339,886 | B1 | 1/2002 | Reinhardt | |
| 7,281,578 | B2 | 10/2007 | Nakajima | |
| 7,698,937 | B2 | 4/2010 | Neidhardt | |
| 8,024,868 | B2 | 9/2011 | Brannigan | |
| 8,484,858 | B2 | 7/2013 | Brannigan | |
| 8,905,148 | B2 * | 12/2014 | Nelson | E21B 4/18 166/382 |
| 2006/0064889 | A1 * | 3/2006 | Fredette | E21B 47/08 33/544 |
| 2010/0319991 | A1 * | 12/2010 | Brannigan | E21B 47/08 175/40 |
| 2012/0055711 | A1 * | 3/2012 | Brannigan | E21B 47/08 175/50 |
| 2014/0138084 | A1 | 5/2014 | Al-Mulhem | |
| 2016/0003029 | A1 * | 1/2016 | Hay | E21B 47/022 702/7 |
| 2016/0032717 | A1 * | 2/2016 | Parker | E21B 47/01 367/7 |
| 2016/0061776 | A1 * | 3/2016 | Aslanyan | E21B 47/01 324/339 |
| 2018/0038222 | A1 * | 2/2018 | Samson | E21B 47/102 |

* cited by examiner

BORE MEASURING TOOL

BACKGROUND OF THE INVENTION

1. Field of Invention

The present invention relates generally to measuring down-hole bores and in particular to an apparatus and method for measuring well bores in line with a tool string.

2. Description of Related Art

In oilfield applications, tubular wells (boreholes or wellbores) are directionally drilled through the earth using a drilling string suspended from a drilling rig. A drilling string is a collection of assembled parts including drill pipe, drill collars, tools and the drill bit. The parts are threadably coupled together to form the drill string, with the drill bit on the distal end of the string. The drilling rig may include equipment to rotate the drilling string, or the drilling string may include a mud motor, which uses hydraulic energy from drilling fluid to turn the drill bit, independent of the drill string. The drilling fluid, also known as drilling mud, passes through the interior of the drilling string, exiting the string at the drill bit and is subsequently pumped back to the surface around the exterior of the drilling string, carrying the drill cuttings with it for treatment and disposal.

It is desirable and common practice to measure the physical properties of the wellbore during or following drilling operations. Information may be obtained about the well path and position, depth, bottom-hole location, geophysical properties of the rock, etc. This information can be used to optimize the efficiency of the wellbore placement and provide information for future well use as well as any remedial steps which must be performed on the well bore.

Measurement while drilling (MWD) components may include a variety of sensors which allow for continued drilling operation while collecting data with the sensors. It should be noted that in the art it is known to distinguish between the terms "measurement while drilling" (MWD) and "logging while drilling" (LWD) in that the MWD term generally refers to measurements relating to the progress of the drilling operation (such as the trajectory, rate of penetration, etc.), whereas LWD relates to information about the wellbore physical properties (such as the porosity of the rock, vertical seismic profile, etc.). For the purpose of the description of the present invention, "wellbore measurement" is intended to cover both classifications of sensors, without limiting the type of sensors that may be described below.

Conventional methods of wellbore measurement have included tools with multiple sensors. However, many of these tools are separate from the drill string, not permitting a fluid bypass, and thus drilling operation must be ceased and the drill string may need to be removed before such tools can be inserted for measurements to be taken. Examples of such devices with multiple sensors include CN102337884 CN202194563 and CN20241128, U.S. Pat. No. 7,6989,937 to Neidhardt, U.S. Pat. No. 4,673,890 to Copeland et al., U.S. Pat. No. 7,281,578 to Nakajima et al. And US Patent Application Publication No. 2014/0138084 to Al-Mulhem.

Applicant is aware of wall contact caliper instruments for use in a drilling string which includes a bypass passage through the tool such that the drilling operation does not need to be ceased while measurements are taken. Such devices do not detect the profile of the well bore directly, but rather detect the difference in the height between the top and bottom of the tool to measure the average diameter of the bore. Examples of such devices may be found in U.S. Pat. No. 8,024,868 to Brannigan et al.

SUMMARY OF THE INVENTION

According to a first embodiment of the present invention there is disclosed an apparatus for measuring a well bore wall comprising a casing connectable in line with a tool string having a central passage therethrough and extending between first and second ends and a plurality of longitudinally extending biasing elements extending longitudinally along the body between first and second ends wherein each of the second end of the biasing elements is connected to the casing body. The apparatus further comprises a sensor located along a midpoint of each of the biasing elements and an engagement body located within the central passage of the casing longitudinally displaceable therein between first and second positions, wherein the engagement body is connected to the first end of each of the biasing elements such that displacement of the engagement body within the central passage from the first to the second positions compresses and radially extends the biasing elements so as to engage the sensors against the well bore wall.

The central passage may have a first portion proximate to a first end of the casing and a second portion at a middle thereof. The second portion of the central passage may be larger than the first portion. The first and second portions of the central passage may include an annular shelf extending therebetween.

The engagement body may comprise a disk. The disk may have a diameter larger than the first portion so as to be retained within the second portion. The disk may include a plurality bores therethrough. The plurality of bores may be positioned to be sealed by the disk when the disk is engaged thereon.

The casing may include a plurality of longitudinal slots extending therealong. The apparatus may further include a carriage located in each slot. Each of the carriages may be connected to the engagement body. The biasing elements may extend along the slot. The biasing elements may extend between the carriage and a distal end of the slot. The biasing elements may comprise springs.

The apparatus may further comprise a transfer body positioned within the first portion of the central passage being displaceable therein. The transfer body may have leading edge adapted to receive a dropped ball thereon. The transfer body may have a length selected to be located within the second portion of the central passage at the second position of the engagement body.

According to a further embodiment of the present invention there is disclosed a method for measuring a well bore wall comprising providing a casing in line within a tool string and displacing an engagement body within a central passage of the casing from a first position to a second position to compress and radially extend a plurality of longitudinally extending biasing elements connected thereto. The method further comprises recording at least one measurement of the well bore wall with a sensor located on each of the radially extended biasing elements.

Displacing the engagement body may comprises engaging a blocking body upon a transfer sleeve above the engagement body, applying a pressure to a top side of the blocking body and the transfer body and displacing and the engagement body under the pressure. The method may further comprise uncovering at least one bypass port through the engagement body at the second position.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

Figure 1:
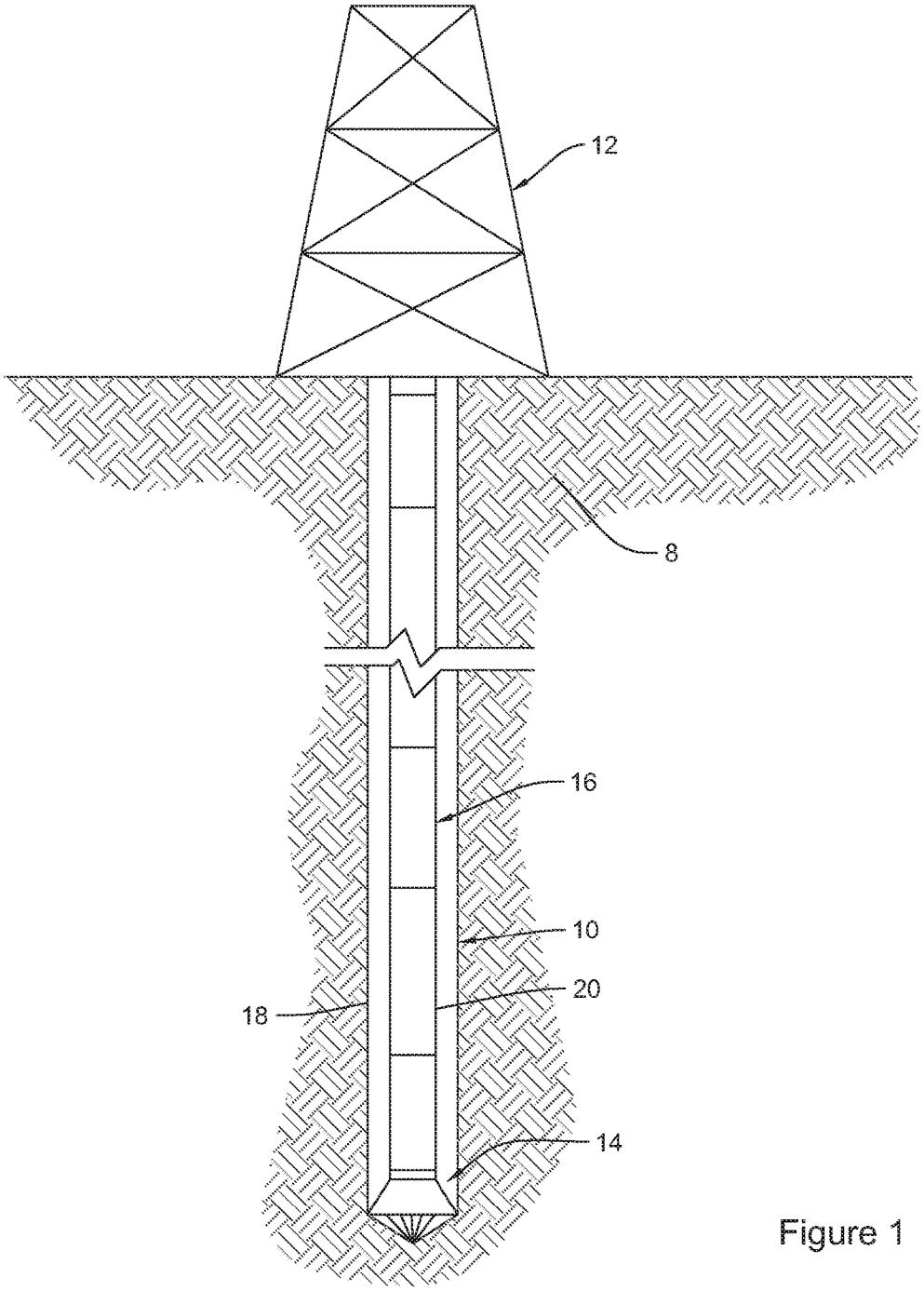
FIG. 1 is a cross sectional view of a wellbore having a drilling string therein which includes an apparatus for measuring the well bore wall.

Referring to FIG. 1, a wellbore 10 is drilled into the ground 8 by known methods. The production zone may contain a horizontally extending hydrocarbon bearing rock formation or may span a plurality of hydrocarbon bearing rock formations such that the wellbore 10 has a path designed to cross or intersect each formation. As illustrated in FIG. 1, the wellbore includes a drilling rig 12 at a top end thereof and a drilling or bottom hole assembly 14 at a distal end of a drill string 16 extending therebetween. As illustrated in FIG. 1, a wellbore measuring apparatus 20 is located within the drill string 16 for measuring the properties and characteristics of the well bore wall 18 as will be further described below.

Figure 2:
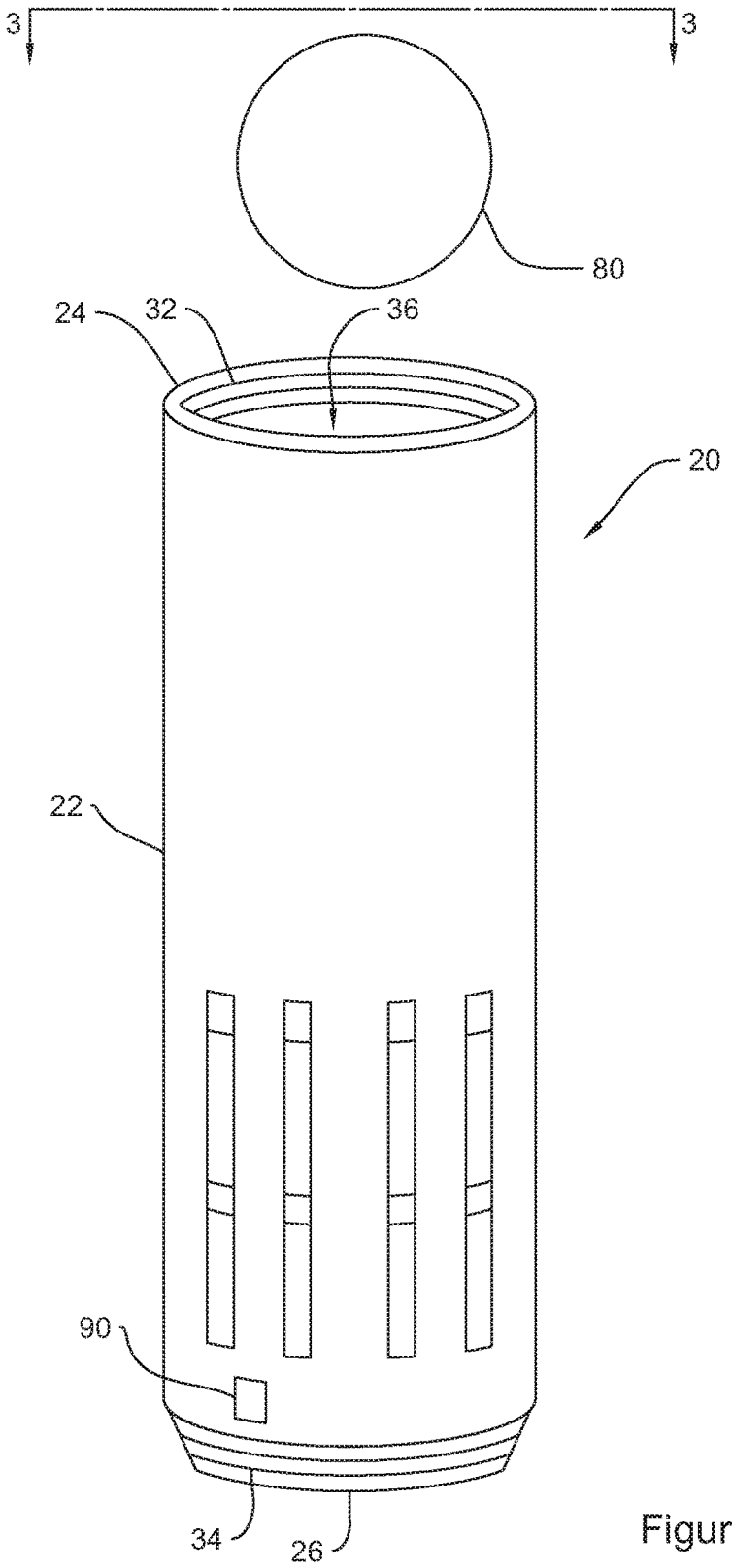
FIG. 2 is a perspective view of a well bore measuring apparatus for use in the drilling string of FIG. 1.
Figure 3:
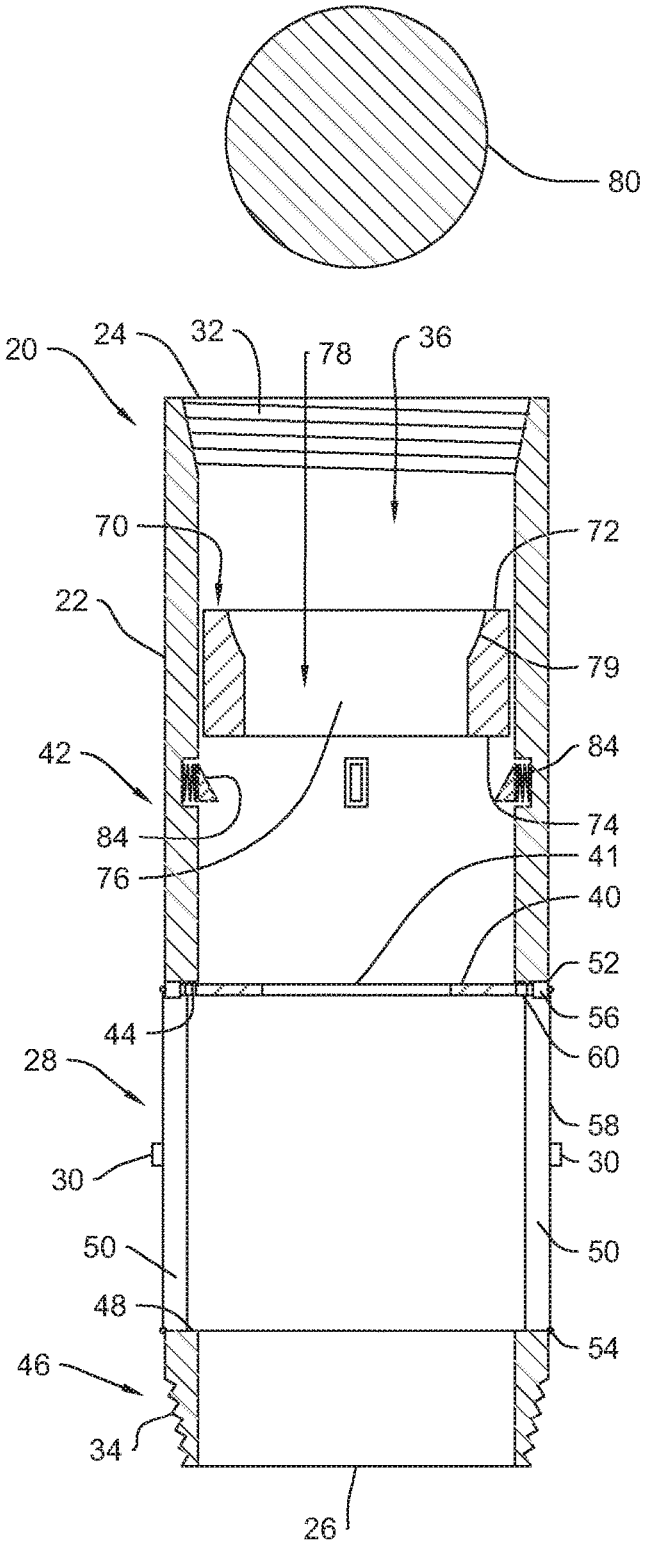
FIG. 3 is a cross-sectional view of the apparatus of FIG. 2 taken along line 3-3 in a first or disengaged position.
Figure 4:
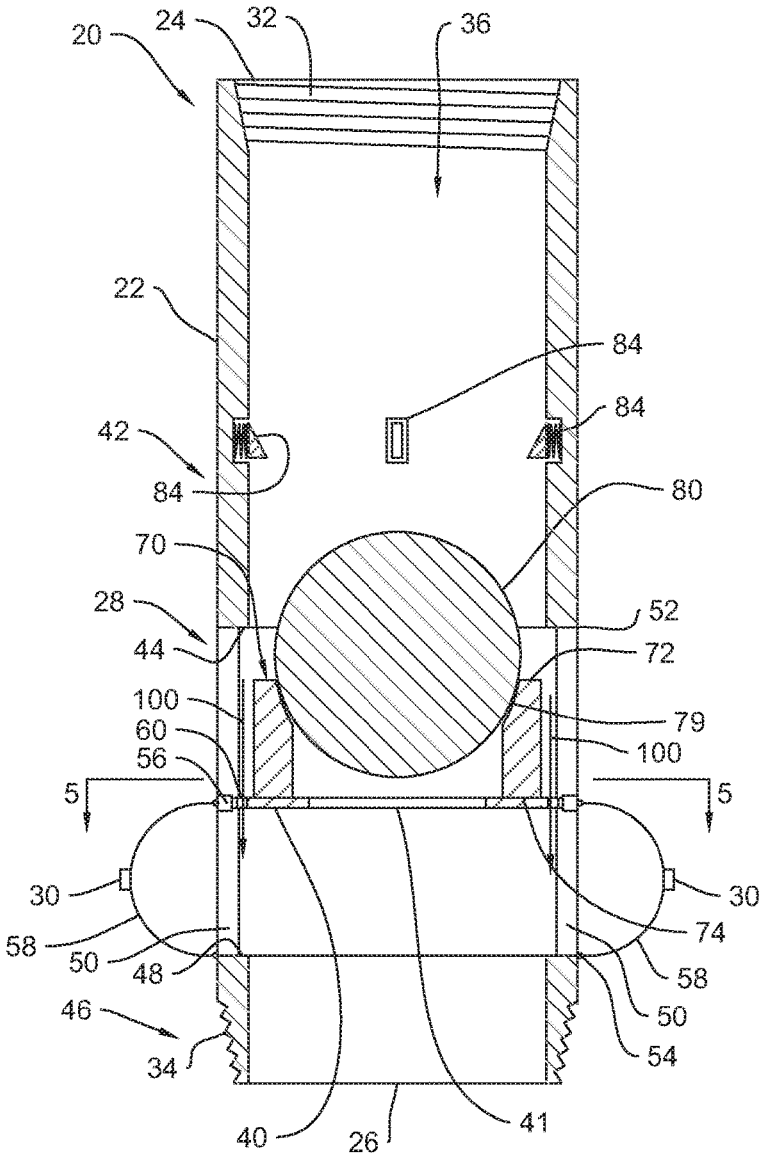
FIG. 4 is a cross-sectional view of the apparatus of FIG. 2 taken along the line 3-3 in a second or extended position.

Turning to FIGS. 2 through 4, an apparatus 20 for measuring a well bore as set out above comprises a casing 22 extending between first and second ends, 24 and 26, respectively and including a middle or cage portion 28 at a middle thereof. As illustrated in FIGS. 3 and 4, the apparatus 20 includes a plurality of spring biased sensors 30 extendable by the displacement of an actuating plate 40 therein into contact with, or proximity to the well bore wall 18 as will be described further below.

The casing 22 is sized to be coupled within the drill string 16, and having internal end threading 32 at the first end 24 and external end threading 34 at the second end 26. The internal and external threading, 32, 34, are selected to correspond to and be matable with other drill string threading, as are commonly known. The casing 22 defines an interior passage 36 therethrough having a lead portion 42 proximate to the first end 24 and a cage portion 28 located at the midpoint thereof. The diameter of the lead portion 42 of the interior passage 36 is less than the diameter of the cage portion 28. An inward annular shoulder 44 defines the separation between the lead portion 42 and cage portion 28. A bottom portion 46 of the interior passage 36I located proximate to the second end 26 end and matches the diameter of the lead portion 42, with an annular shoulder 48 between the cage and bottom portions 28, 46.

Figure 5:
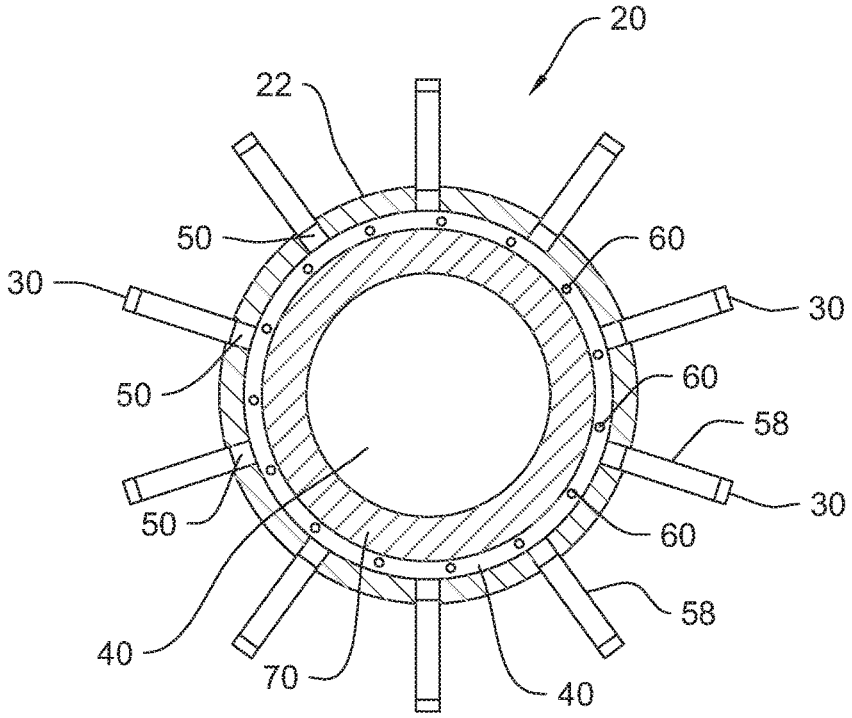
FIG. 5 is a cross sectional view of the apparatus of FIG. 2 as taken along the line 5-5 of FIG. 4.
Figure 6:
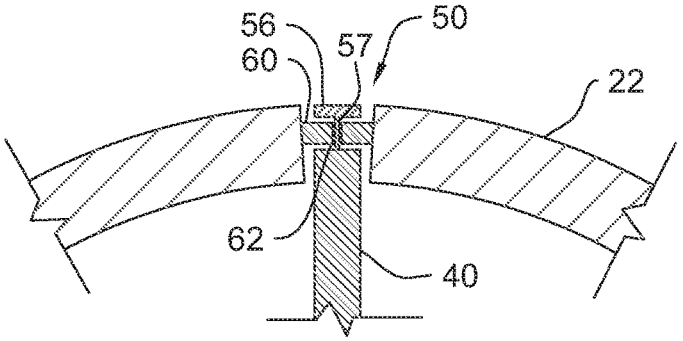
FIG. 6 is a detailed cross sectional view of one of the slots of the apparatus of FIG. 2 as taken along the line 5-5 of FIG. 4.

As shown best on FIG. 5, the cage portion 28 of the casing 22 includes a plurality of longitudinal slots 50 extending through the casing 22 which may be distributed axially around the casing 22 at the cage portion 28. The quantity of slots 50 may range from 10to 18, although it may be appreciated that other quantities may be useful, as well. As illustrated, the slots 50 may be arranged radially at regular angles around the casing although it will be appreciated that other configurations may be useful as well. The slots 50 extend between a first end 52 located towards the first end 24 of the casing 22 and slot second end 54 located towards the second end 26 of the casing 22. A carriage 56 is located within each slot. A leaf spring 58, or other biasing member, may be fixed to the carriage 56 and to the casing 22 at the second end 54 of the slot 50. Each slot 50 is sealed with an anticorrosive rubber seal 64 located therein which incorporates a slit 62 through which each carriage 56 may be connected to the actuating plate 40 as illustrated in FIG. 6. The carriages 56 may include a narrowed portion 57 extending through the slit 62 to the actuating plate 40. Sensors 30 may be attached to each leaf spring 58 and may be extended therefrom. As illustrated, the sensors 30 may be located at a midpoint of the leaf spring 58 span, although other locations may be useful as well. As illustrated in FIG. 3, the leaf spring 58 may be sized to substantially span the length of the slot 50 when in the resting or inert position so as to position the carriage proximate to the first end 52 of the slot 50 at such position.

Referring to FIGS. 3, 4 and 5, the cage portion 28 contains a disk shaped actuating plate 40 sized to fit therein. The diameter of the actuating plate 40 is sized to slide within the cage portion 28, having a larger diameter than the lead portion 42 of the interior passage, such that the actuating plate 40 will not slide past annular shoulder 44. The actuating plate 40 may have a thickness ranging such as from 1 to 2 inches (25.4 to 50.8 mm), although it may be appreciated that other thicknesses may be useful, as well. A plurality of bypass bores 60 are positioned in a circular array proximate to the exterior edge of the actuating plate 40, such that they are positioned to be covered by the annular shoulder 44 when the actuating plate 40 is located at the first position as illustrated in FIG. 3. A central bore 41 is located in the centre of the actuating plate 40 to permit fluid to pass therethrough prior to a ball being dropped into contact with the ball seat as set out below. The plurality of carriages 56 may be attached to the actuating plate 40 such that they are seated within the plurality of slots 50.

A cylindrical engagement sleeve 70 is sized to fit within the lead portion 42 such that it can slide therein. The engagement sleeve 70 extends between lead and second ends 72 and 74, respectively, with a central bore 76 defining a passage 78 therethrough. The passage 78 continues through central bore 41 in the actuating plate 40. The central bore 76 has a profiled ball seat 79 at the lead end 72 such that an engagement ball 80 can be seated therein, thus sealing passage 78, as shown in FIG. 4. The length of engagement sleeve 70 may range such as from 6 to 24 inches (152 to 610 mm), although it may be appreciated that other lengths may be useful, as well. The engagement sleeve 70 is maintained in position by spring loaded wedges 84 located below the ball seat 70. After the ball seat 70 is shifted downwardly within the interior passage 36, the wedges 84 will return to their extended position as illustrated thereby preventing an upward return of the ball seat 70 to the run in position. It will also be appreciated that other devices for retaining the ball seat 70 at the run in position illustrated in FIG. 3 may also be utilized such as, by way of non-limiting example, shear pins or the like.

In operation the apparatus 20 may be located within a drill string 16 and the drilling operation performed as is commonly known. When an operator desires to activate the apparatus 20, an engagement ball 80 is released within the drill string 16. The ball 80 is sized to pass through the interior passage of all drill string 16 components, and to be seated snugly within the ball seat 79 of the engagement sleeve 70. As the ball 80 is seated within engagement sleeve 70, the hydraulic fluid builds pressure on the now sealed engagement sleeve 70, which shifts down past the pressure gradient mechanisms to engage upon the actuating plate 40. Further pressure thereon displaces the actuating plate 40 and engagement sleeve 70 within cage portion 28, longitudinally sliding the carriages 56 within the slots 50 and subsequently extending leaf springs 58 with attached sensors 30 through the slits in the rubber seals. As the actuating plate 40 is displaced within the cage portion 28, bypass bores 60 are exposed, allowing hydraulic fluid to pass therethrough once the engagement sleeve 70 has been displaced past annular shoulder 44, as indicated at 100 on FIG. 4, while maintaining sufficient pressure to continuously maintain the sensors at the extended position. Hydraulic fluid continues to pass through passages 36 and 82, allowing continued operation of the drill string during wellbore measurement with the sensors 30.

Sensors 30 may be radius proximity sensors, or other sensor types commonly used in the art, depending on the desired data outcome. As there are a plurality of sensors on the cage portion 28, a variety of sensor types could be mounted on leaf springs 58. The sensors 30 may be connected, as is commonly known, by wire to a memory card 90 enclosed within the casing 22. It will be appreciated that the sensors 30 may be selected to measure a desired characteristic of the well bore as are commonly known in the art. The memory card 90 could store data received from the sensors 30 until the apparatus 20 is removed from the wellbore 10 for review following the drilling operation. Alternately, signals from the sensors 30 may be communicated to the surface over a signal line, within wired drill pipe, or through any other method as is commonly known in the art.

The casing 22 may be fabricated using metal composites, using any common forming methods, such as casting, molding, or machining, by way of non-limiting example. It will be appreciated that all components of the present device will be required to be formed of materials and in sufficient thicknesses and dimensions to withstand the torque stress, pressure, temperature and anticorrosive standards of bottom hole assemblies as are commonly known.

While specific embodiments of the invention have been described and illustrated, such embodiments should be considered illustrative of the invention only and not as limiting the invention as construed in accordance with the accompanying claims.

What is claimed is:

1. An apparatus for measuring a well bore wall comprising:

a casing connectable in line with a tool string having a central passage therethrough and extending between first and second ends;

a plurality of longitudinally extending biasing elements extending longitudinally along said casing wherein a second end of each of said biasing elements is connected to said casing;

a sensor located along a midpoint of each of said biasing elements;

an engagement body located within said central passage of said casing longitudinally displaceable therein between first and second positions, wherein said engagement body is connected to a first end of each of said biasing elements such that displacement of said engagement body within said central passage from said first to said second positions compresses and radially extends said biasing elements so as to engage said sensors against the well bore wall; and wherein said central passage has a first portion proximate to said first end of said casing and a second portion at a middle thereof, wherein said second portion of said central passage is larger than said first portion.

2. The apparatus of claim 1 wherein said first and second portions of said central passage include an annular shelf extending therebetween.

3. The apparatus of claim 2 wherein said engagement body comprises a disk.

4. The apparatus of claim 3 wherein said disk has a diameter larger than said first portion so as to be retained within said second portion.

5. The apparatus of claim 4 wherein said disk includes a plurality of bores therethrough.

6. The apparatus of claim 5 wherein said plurality of bores are positioned to be sealed by said annular shelf when said disk is engaged thereon.

7. The apparatus of claim 2 further comprising a transfer body positioned within said first portion of said central passage being displaceable therein.

8. The apparatus of claim 7 wherein said transfer body has a leading edge adapted to receive a dropped ball thereon.

9. The apparatus of claim 8 wherein said transfer body has a length selected to be located within said second portion of said central passage at said second position of said engagement body.

10. The apparatus of claim 1 wherein said casing includes a plurality of longitudinal slots extending therealong.

11. The apparatus of claim 10 further including a carriage located in each slot.

12. The apparatus of claim 11 wherein each of said carriages is connected to said engagement body.

13. The apparatus of claim 12 wherein said biasing elements extend along said slot.

14. The apparatus of claim 13 wherein each of said biasing elements extend between said carriage and a distal end of said slot.

15. The apparatus of claim 1 wherein said biasing elements comprise springs.

16. A method for measuring a well bore wall comprising:

providing a casing in line within a tool string;

displacing an engagement body within a central passage of said casing from a first position to a second position to compress and radially extend a plurality of longitudinally extending biasing elements connected thereto;

recording at least one measurement of the well bore wall with a sensor located on each of said radially extended biasing elements; and wherein said central passage has a first portion proximate to a first end of said casing and a second portion at a middle thereof, wherein said second portion of said central passage is larger than said first portion.

17. The method of claim 16 wherein said displacing said engagement body comprises engaging a blocking body upon a transfer sleeve above said engagement body, applying a pressure to a top side of said blocking body and said transfer body and displacing and said engagement body under said pressure.

18. The method of claim 16 further comprising uncovering at least one bypass port through said engagement body at said second position.

* * * * *